US006499738B2

(12) United States Patent
Slocum et al.

(10) Patent No.: US 6,499,738 B2
(45) Date of Patent: Dec. 31, 2002

(54) SWEEP GUIDE SYSTEM

(75) Inventors: Douglas A. Slocum, New Milford, PA (US); Patrick J. Fitzgibbons, Newark Valley, NY (US); Bruce H. Hanson, Endicott, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 97 days.

(21) Appl. No.: 09/797,685

(22) Filed: Mar. 5, 2001

(65) Prior Publication Data

US 2002/0121735 A1 Sep. 5, 2002

(51) Int. Cl.[7] ..... B65H 29/34
(52) U.S. Cl. ..... 271/189
(58) Field of Search ..... 271/302, 189, 271/192

(56) References Cited

U.S. PATENT DOCUMENTS 3,640,521 A * 2/1972 Hutley ..... 271/192
5,695,071 A 12/1997 Ross et al.
5,697,605 A * 12/1997 Pollich et al. ..... 271/189
5,718,321 A 2/1998 Brugger et al.
5,758,981 A 6/1998 Lesniak et al.
5,992,609 A 11/1999 Maier
6,131,901 A 10/2000 Hirohata

FOREIGN PATENT DOCUMENTS

DE 199 47 329 A 1 * 4/2001 ..... B65H/31/32

* cited by examiner

*Primary Examiner*—Donald P. Walsh
*Assistant Examiner*—Kenneth W Bower
(74) *Attorney, Agent, or Firm*—Schwartz & Weinrieb

(57) ABSTRACT

A conveyor or article transportation system for conveying or transporting, for example, pieces or units of mail, or similar flat articles, has a pair of guide fingers operatively extending downstream from a downstream end of the conveyor so as to project into a stacking chamber within which the pieces or units of mail, or flat articles, are to be stacked. The guide fingers effectively vertically support the downstream end portions of the pieces or units of mail, or articles, such that the downstream end portions of the mail or articles do not curl or curve downwardly, or sag, whereby the pieces of mail or articles are deposited within the stacking chamber in a substantially flat state so as to prevent rollover of the pieces of mail or articles which would otherwise become jammed within the stacking system and cause upstream jamming or interruptions within the conveying system. In addition, the prevention of the curling or rollover of the pieces of mail or articles, in turn, prevents the pieces or articles from being stacked partially inside each other and therefore out of their previously sorted serial sequence.

22 Claims, 3 Drawing Sheets

SWEEP GUIDE SYSTEM

FIELD OF THE INVENTION

The present invention relates generally to article conveying or transporting systems, and more particularly to a new and improved system for use within, for example, mail or similar flat article sorting, transporting, handling, and stacking systems, wherein flat pieces or units of mail, such as, for example, post cards, magazines, fliers, or the like, or other similar articles, which would otherwise tend to roll over on themselves in a semi-circular form, as a result of being precurled, or as a result of undergoing curvature or sagging, after being released from its conveyor mechanism and deposited within a stacked array formed within a suitable accumulation and stacking chamber, receptacle, or compartment, are effectively prevented from undergoing or experiencing such rollover so as not to adversely affect the continuous mail or article sorting, transporting, handling, and stacking operations.

BACKGROUND OF THE INVENTION

In connection with mail or similar flat article sorting, transporting, stacking, and handling systems, flat pieces or units of mail, or other similar articles, are conventionally transported by means of a suitable conveyor, such as, for example, a belt conveyor comprising a plurality of laterally spaced endless belts, and the transported pieces of mail or similar articles are then adapted to be sorted and stacked within stacked arrays or piles formed within a stacking chamber, receptacle, or compartment. In view of the fact that different types of pieces or units of mail, or similar articles, having, for example, different size or length dimensions, are being continuously conveyed or transported by means of the transport conveyor mechanism toward and into the stacking chamber, receptacle, or compartment, care must be taken so as to ensure the fact that the pieces or units of mail, or the similar articles, are in fact serially placed upon each other in a flat stacked array. This mode of operation, however, is not always able to be readily achieved, and therefore, problems or difficulties often occur in connection with maintaining the system continuously operative with minimum operational downtime.

For example, in connection with the conveyance, transportation, and handling of conventional stiff post cards, and due to the inherent structural characteristics of stiff post cards, that is, that they exhibit a somewhat greater degree of rigidity than, for example, twenty pound weight paper, or the like, as a result of being fabricated from a different type of paper product than, for example, twenty pound weight paper, post cards are easily bent and also tend to exhibit or undergo curling. Similarly, magazines have a relatively low degree of rigidity and therefore tend to readily curve downwardly or sag. Accordingly, when such flat articles are being transported or conveyed within a conventional mail or similar article sorting, transporting, handling, and stacking system, they can cause operational problems or difficulties because they do not tend to remain in a relatively flattened state.

More particularly, when such flat articles are released from the belted conveyor transport and allowed to fly toward and into the stacking chamber, receptacle, or compartment so as to be placed flatly on top of a stacked array within the stacking chamber, receptacle, or compartment, the curling of the flat articles often causes leading edge portions of the mail pieces to roll over onto themselves in flight, or to trip and roll over when encountering a trailing edge portion of a previously stacked flat article within the stacking chamber, receptacle, or compartment. As a result of such encounter, the incoming flat article is not in fact deposited, in a flat and face-up orientation, on top of the stacked array of previous pieces, articles, or units, so that subsequent flat articles are also not properly deposited upon the stacked array of the previous flat articles. In this case, jamming of the conveyor and stacking system can occur necessitating an operational stoppage of the system until the jammed state of the flat article is able to be rectified. Equally importantly, even if a jam does not occur, subsequent mail fed to the stack will not always come to rest fully and completely on top of the previous curled piece, which had come to rest in its semi-circular form, whereby the previous curled piece nests a subsequent piece inside of it. This nesting of the subsequent or following piece partially inside of the previous semi-rolled-over piece causes an out of order mixing situation of the previously sorted flat articles.

A need therefore exists in the art for a new and improved article conveyor or transportation system, particularly a conveyor or transportation system which is especially useful in connection with the sorting, transporting, handling, and stacking of pieces or units of mail, or similar articles, wherein the various pieces or units of mail, or similar articles, can be conveyed or transported, for example, from the belt conveyor toward and into the stacking chamber, receptacle, or compartment in a substantially flat state regardless of the inherent tendency of the particular pieces or units of mail, or similar flat articles, to either curl, curve, or sag, causing partial or complete rollovers, whereby the pieces or units of mail, or similar articles, can be properly stacked within the stacking chamber, receptacle, or compartment so as not to cause any hindrance to the continuous conveyance or transportation of the pieces or units of mail, or similar flat articles, whereby, further, the article conveyor or transportation system can operate in a substantially continuous manner without experiencing any jamming and that the flat articles all stack serially.

OBJECTS OF THE INVENTION

Accordingly, it is an object of the present invention to provide a new and improved article conveyor or transportation system which is especially useful in connection with the sorting, transporting, handling, and stacking of pieces or units of mail or similar flat articles.

Another object of the present invention is to provide a new and improved article conveyor or transportation system which is especially useful in connection with the sorting, transporting, handling, and stacking of pieces or units of mail, or similar articles, and which effectively overcomes the various disadvantages or drawbacks characteristic of current conventional article sorting, transporting, handling, and stacking systems.

An additional object of the present invention is to provide a new and improved article conveyor or transportation system which is especially useful in connection with the sorting, transporting, handling, and stacking of pieces or units of mail, or similar articles, wherein the various pieces or units of mail, or similar articles, can be conveyed or transported, for example, from the belt conveyor toward and into the stacking chamber, receptacle, or compartment in a substantially flat state regardless of the inherent tendency of the particular pieces or units of mail, or similar articles, to either curl, curve, or sag, causing partial or complete rollovers, whereby the pieces or units of mail, or similar articles, can be properly serially stacked within the stacking chamber, receptacle, or compartment.

A further object of the present invention is to provide a new and improved article conveyor or transportatation system which is especially useful in connection with the sorting, transporting, handling, and stacking of pieces or units of mail, or similar articles, wherein the various pieces or units of mail, or similar articles, can be conveyed or transported, for example, from the belt conveyor toward and into the stacking chamber, receptacle, or compartment in a substantially flat state regardless of the inherent tendency of the particular pieces or units of mail, or similar articles, to either curl, curve, or sag, causing partial or complete rollovers, whereby the pieces or units of mail, or similar articles, can be properly stacked within the stacking chamber, receptacle, or compartment so as not to cause any hindrance to the continuous conveyance or transportation of the pieces or units of mail, or similar flat articles, whereby, further, the article conveyor or transportation system can operate in a substantially continuous manner without experiencing any jamming so as to obviate or render unnecessary required maintenance in order to rectify the problem and to additionally eliminate any operational downtime of the apparatus or system.

SUMMARY OF THE INVENTION

The foregoing and other objectives are achieved in accordance with the teachings and principles of the present invention through the provision of a new and improved article conveyor or transportation system which is especially useful in connection with the sorting, transporting, handling, and stacking of different pieces or units of mail, or similar flat articles, and which comprises a belt conveyor for conveying or transporting the pieces or units of mail, or similar articles, and a stacking chamber, receptacle, or compartment within which the conveyed or transported pieces or units of mail, or similar articles, are stacked. A pair of guide fingers are pivotally mounted upon a wall member, disposed at the upstream end of the stacking chamber, receptacle, or compartment, so as to be disposed at an elevational level which is just slightly below the upper level of the belt conveyor, wherein the guide fingers are also movable between closed deployed or extended positions, and opened non-deployed or retracted positions.

When the guide fingers are disposed at their closed deployed or extended positions, the guide fingers overly the floor of the stacking chamber, receptacle, or compartment, or alternatively, the uppermost one of the stacked pieces or units of mail, or similar articles, so as to effectively extend the plane of the belt conveyor. The closed deployed or extended guide fingers will therefore be disposed beneath the piece or unit of mail, or similar article, currently being conveyed, and in this manner, the guide fingers support the leading end of the piece or unit of mail, or similar flat articles, and thereby ensure that the leading end of the piece or unit of mail, or similar flat article, being conveyed cannot in effect curl downwardly of sag significantly so as to either roll over upon itself or encounter a trailing edge portion of a previously conveyed piece or unit of mail, or similar article, now disposed upon the stacked array of mail or articles, whereby in addition, the piece or unit of mail, or similar article, being conveyed is in fact deposited either upon the floor of the stacking chamber, receptacle, or compartment, or upon the uppermost one of the stacked pieces or units of mail, or similar articles, in a substantially flattened state.

Once the piece or unit of mail, or similar article, has been conveyed into the stacking chamber, receptacle, or compartment so as to be properly disposed within the stacked array of pieces or units of mail, or similar articles, the guide fingers are then moved back to their opened non-deployed or retracted positions so as to effectively become dislodged from their positions beneath the piece or unit of mail, or similar article, just deposited within the stacking chamber, receptacle, or compartment, and in this manner, the piece or unit of mail, or similar article, just deposited within the stacking chamber, receptacle, or compartment can actually be disposed atop the floor of the stacking chamber, receptacle, or compartment, or alternatively upon the uppermost one of the stacked pieces or units of mail, or similar articles, in a flat and serial manner. Subsequently, the guide fingers are again moved back to their closed deployed or extended positions so as to now be disposed atop the uppermost one of the pieces or units of mail, or similar articles, disposed within the stacked array of mail or articles, in readiness for guiding a newly conveyed piece or unit of mail, or similar article, onto the stacked array of mail or articles. The apparatus or system is then continuously operated in the aforenoted cyclical manner.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
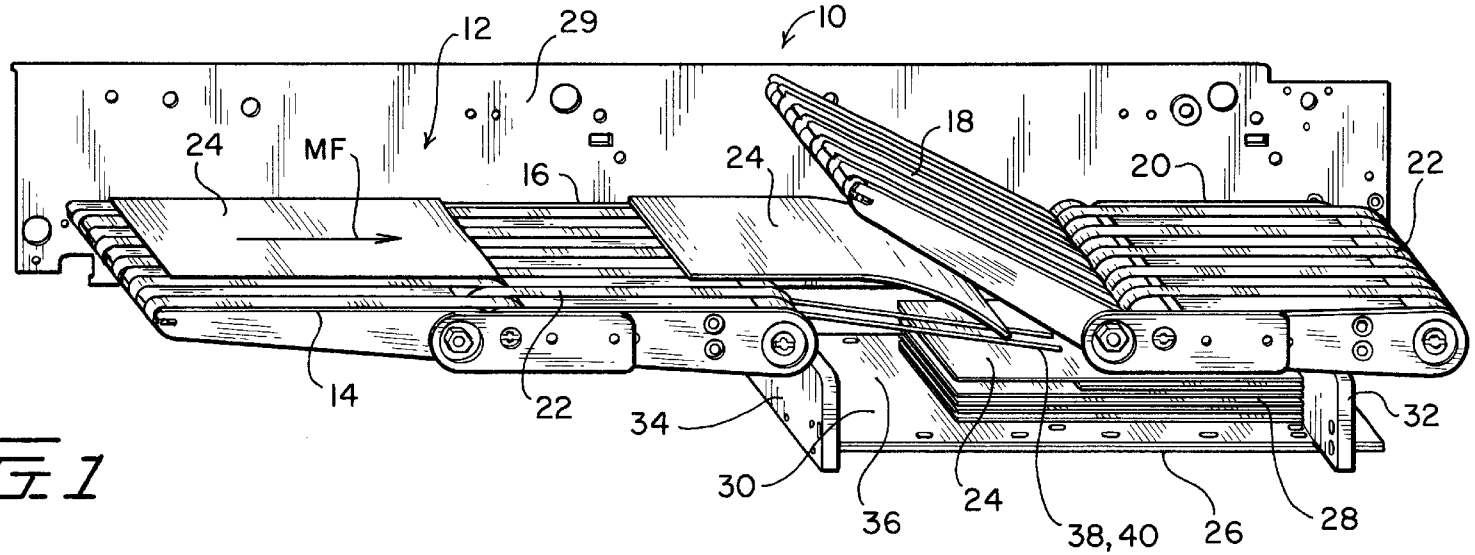
FIG. 1 is a right side perspective view of the new and improved article conveyor or transportation system which has been constructed in accordance with the principles and teachings of the present invention so as to be especially useful in connection with the sorting, transporting, handling, and stacking of different pieces or units of mail or similar articles.

Referring now to the drawings, and more particularly to FIGS. 1–4 thereof, the new and improved article conveyor or transportation system, which has been developed in accordance with the principles and teachings of the present invention, is disclosed and is generally indicated by the reference character 10. As can readily be appreciated from the drawing figures, the new and improved article conveyor or transportation system 10 of the present invention is especially useful in connection with the conveyance or transportation, sorting, and stacking of pieces or units of mail, or similar flat articles, particularly magazines, fliers, or the like, which usually have unique problems or difficulties in maintaining a flat state. As has been noted hereinbefore, magazines and other flimsy articles have a tendency to curve downwardly or sag, and if they tend to curl downwardly, then the flat articles often present problems in connection with the conveyance and stacking of the same within, for example, mail sorting and flat article handling systems. The present invention apparatus or system has been developed in order to effectively address this problem.

Accordingly, it is to be further appreciated that in accordance with the new and improved article conveyor or transportation system 10, which has been developed in accordance with the principles and teachings of the present invention, the system 10 is seen to comprise a belt conveyor 12 which, in turn, comprises a plurality of belt conveyor sections 14,16,18,20. Each belt conveyor section 14,16,18, 20 comprises a plurality of laterally spaced, endless conveyor belts 22, and as is well known in the art, the conveyor belts 22 are driven by suitable motor-drive means, not shown. The conveyor belts 22 are adapted to serially convey or transport, in a longitudinally spaced fashion or mode of operation, various different pieces or units of mail, or similar articles, such as, for example, letters, post cards, fliers, magazines, and the like, and such pieces or units of mail, or similar articles, are generally shown and indicated at 24. As is also well known in the art, conveyed articles of the type with which the present invention is concerned are often sorted by means of automatic light beam transceiver devices and operatively associated software-controlled systems, not shown and not the subject of the present invention, and the sorted articles are then routed into particular receptacles or compartments so as to be stacked in preparation for further transportation, dissemination, distribution, or the like. Accordingly, one of the belt conveyor sections, such as, for example, conveyor diverter section 18, may be mounted within the belt conveyor 12 so as to be pivotally movable into and out of the plane of the belt conveyor 12. When the belt conveyor section 18 is disposed in a coplanar mode with respect to the other belt conveyor sections 14,16, and 20, then pieces or units of mail, or similar articles, 24 continue to be conveyed in the downstream direction. When the belt conveyor diverted section 18, however, is disposed in a non-coplanar mode with respect to the other belt conveyor sections 14,16, and 20, as illustrated, for example, within FIGS. 1 and 2, then belt conveyor diverter section 18 is disposed in a diverter mode whereby the pieces or units of mail, or similar articles, 24 may be conducted, conveyed, or diverted, for example, into an accumulation chamber or compartment 26, which is provided in conjunction with the belt conveyor 12, for accumulating and stacking a plurality of the pieces or units of mail, or similar articles, 24 in a stacked or piled array 28. As can be especially appreciated from FIGS. 1 and 2, the article conveyor or transportation system 10 further comprises a vertically disposed support wall 29, and the stacking chamber or compartment 26 is adapted to be fixedly mounted upon the support wall 29 by means of suitable mounting brackets, not shown.

More particularly, it is seen that the stacking chamber or compartment 26 comprises a floor member 30, a leading or downstream end wall 32, as considered in the longitudinal direction of the mail flow as designated by means of the arrow MF, and a trailing or upstream end wall 34, the oppositely disposed end walls 32, 34 being fixed upon the support wall 29. When it is desired to collect or accumulate the pieces or units of mail, or similar articles, 24 in a stacked array within the stacking chamber or compartment 26, diverter section 18 is pivotally moved to its partially open, inclined diverter position as shown in FIGS. 1 and 2 whereby the pieces or units of mail, or similar articles, 24 are able to be conveyed from the belt conveyor section 16 and into stacking chamber or compartment 26 so as to be deposited either onto the floor member 30 of the stacking chamber or compartment 26 or onto the uppermost one of the pieces or units of mail, or similar articles, 24 disposed upon the stacked array 28.

As has been noted hereinbefore, when the various pieces, articles, or units of mail 24 are being conveyed into the stacking chamber or compartment 26, it often happens that the leading end portion, for example, of some incoming piece of mail, or similar article, 24 tends to curl, curve downwardly, or sag as the same leaves the belt conveyor section 16, and if such curl, curvature, or sagging is significant, the piece of mail or similar article 24 could in effect roll over upon itself and either be deposited upon the stack of mail 28 in such rolled-over state, or alternatively, could become, in effect, lodged within a space 36 which is defined between the trailing or upstream end of the stack of mail 28 and the upstream or trailing end wall 34 of the stacking chamber or compartment 26. In either case, the disposition of such rolled-over article or piece of mail 24 will present free-flowing or continuous conveyance problems with respect to subsequently conveyed or upstream pieces or units of mail, or similar articles, 24. Eventually, the conveyor system 12 will become jammed, and maintenance personnel will have to summoned to service the conveyor 12, necessitating operational stoppage of the conveyor 12 and operational downtime with respect to the entire conveyor system 12. Equally important, subsequently fed mail may come to rest partially inside the previously rolled-over piece whereby such subsequently fed piece of mail is now mixed up or out of order so as to no longer be properly serially stacked.

The new and improved article conveyor or transportation system 10 has therefore been developed in accordance with the principles and teachings of the present invention so as to in fact rectify the deficiencies of prior art conveyor systems whereby the aforenoted jamming and serial order problems or difficulties will not readily occur. More particularly, in accordance with such principles and teachings of the present invention, and as best seen or appreciated from FIGS. 3 and 4, a pair of laterally spaced guide fingers 38,40 are pivotally mounted upon a laterally central portion of the upstream or trailing end wall 34 of the stacking chamber or compartment 26 in a cantilevered manner. The proximal ends of the guide fingers 38,40, by means of which the guide fingers 38,40 are mounted upon the end wall 34 of the stacking chamber or compartment 26, are interconnected together by means of a connector-linkage member 42, and the guide finger 38 is operatively connected to a suitable linear actuator 44, which may be, for example, solenoid or pneumatically operated, by means of an actuator-linkage member 46. It can thus be appreciated that, as a result of the actuating system utilized in connection with the guide fingers 38,40, the guide fingers 38,40 are adapted to be moved in a substantially scissors-type fashion or mode of operation between their extended or closed positions as illustrated in FIG. 3 wherein the guide fingers 38,40 are disposed parallel to each other, and their retracted or opened positions as illustrated in FIG. 4 wherein the guide fingers 38,40 are disposed substantially colinear with respect to each other.

Figure 2:
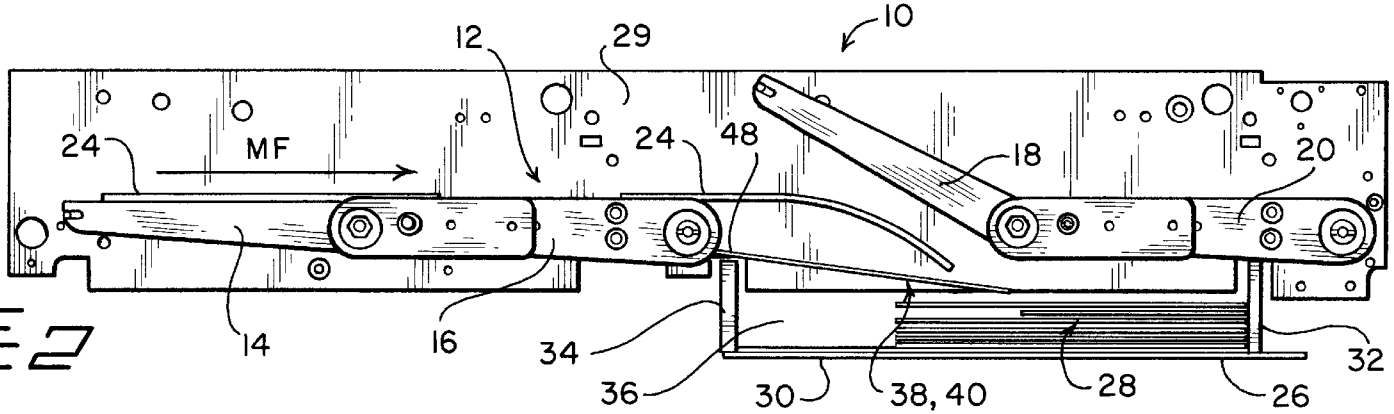
FIG. 2 is a right side elevational view of the new and improved article conveyor or transportation system disclosed within FIG. 1.

It is also to be appreciated, as may best be seen from FIGS. 1 and 2, that the guide fingers 38,40 are inlined downwardly from their proximal or mounting ends pivotally disposed upon the upstream end wall 34 of the stacking chamber or compartment 26 toward their free or distal ends which are adapted to overlie the stack of mail or articles 28 disposed within the stacking chamber or compartment 26 when the guide fingers 38,40 are disposed at their extended or closed positions so as to facilitate the movement and introduction of the articles or pieces of mail 24 into the stacking chamber or compartment 26 and onto either the floor member 30 of the stacking chamber or compartment 26 or atop the uppermost one of the articles or pieces of mail 24 disposed within stacked pile of mail 28. In order to permit the guide fingers 38,40 to be readily moved between their closed or extended positions as shown in FIG. 3, and their opened or retracted positions as shown in FIG. 4, it is further noted that the pivot axles or trunnions 48,48, only one of which is shown in FIG. 2, upon which the proximal ends of the guide fingers 38,40 are mounted, are inclined with respect to a vertical axis and are in fact respectively disposed perpendicular to the planes of the guide fingers 38,40. In this manner, the guide fingers 38,40 are pivotally moved between their extreme opened and closed positions within their own planes and not within horizontal planes so as to permit the guide fingers to be moved to and from their fully opened or retracted positions atop the stacking chamber or compartment end wall 34 as seen in FIG. 4.

Figure 3:
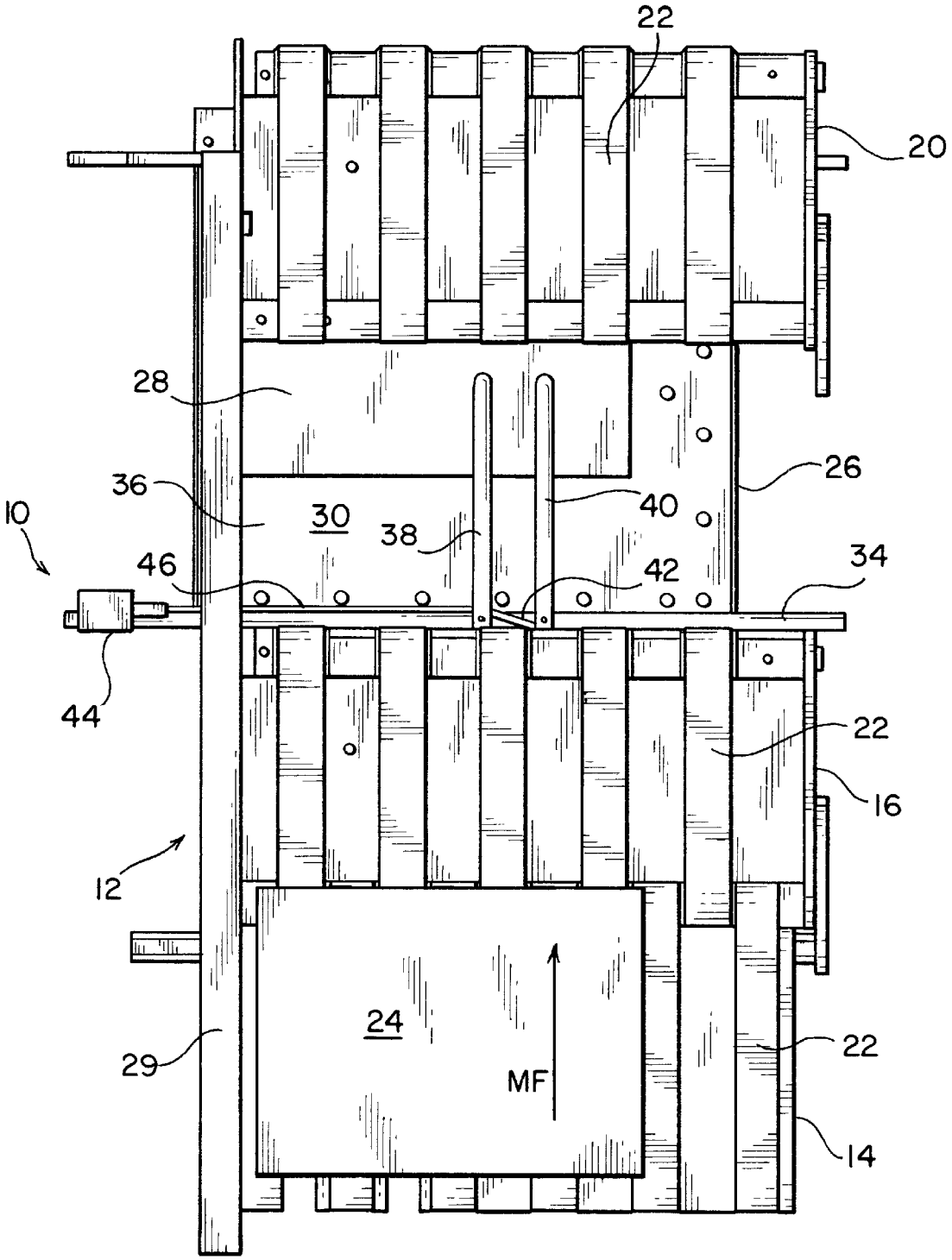
FIG. 3 is a top plan view of the apparatus or system of the present invention as disclosed within FIGS. 1 and 2 wherein the diverter section has been removed so as to clearly illustrate the guide finger mechanisms, and the guide finger mechanisms are disclosed as being at their closed extended or deployed positions.
Figure 4:
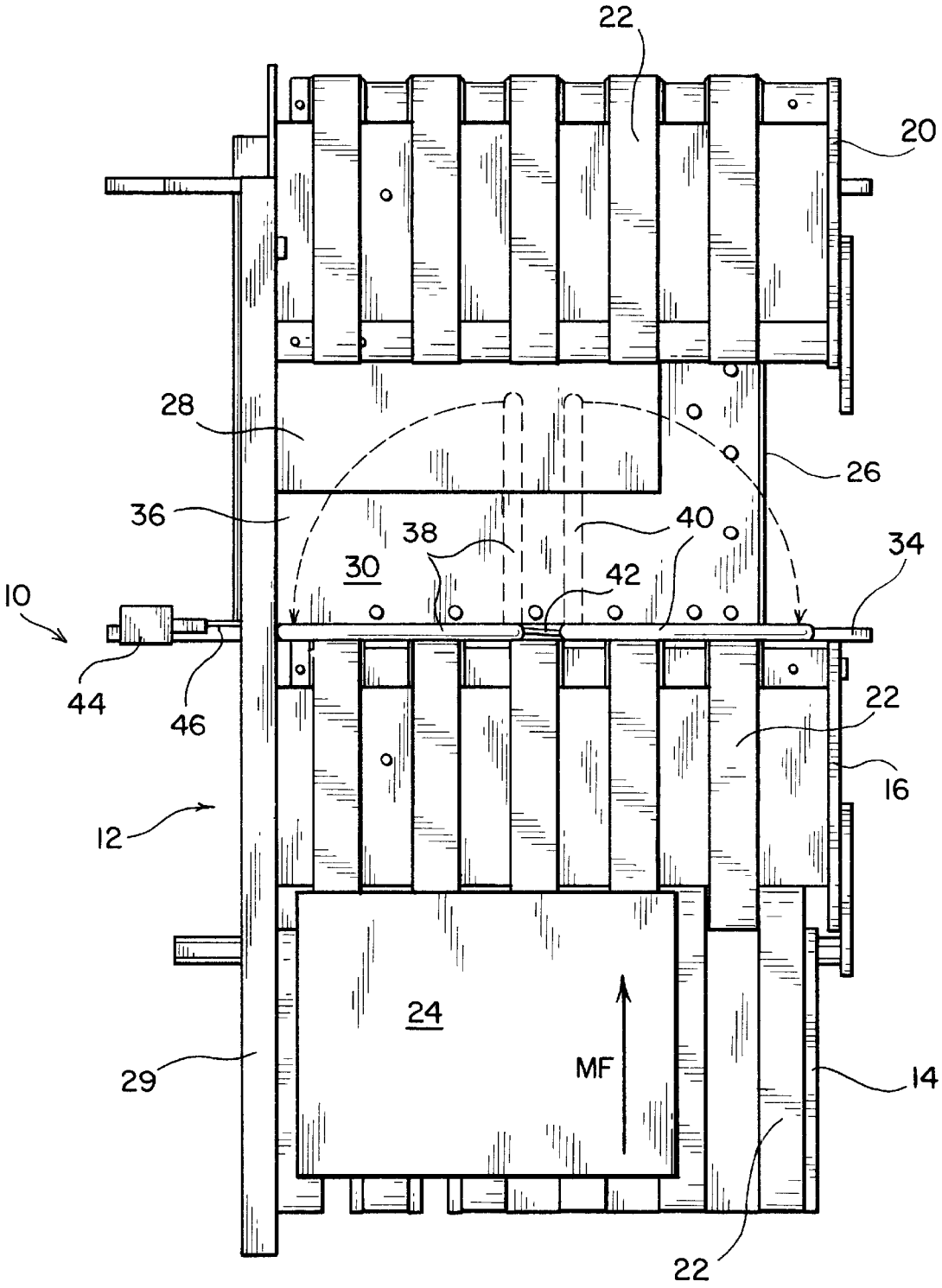
FIG. 4 is a top plan view similar to that of FIG. 3 and therefore also showing the apparatus or system of the present invention as disclosed within FIGS. 1 and 2 wherein, however, one of the conveyor belt sections has been removed so as to clearly illustrate the guide finger mechanisms, and the guide finger mechanisms are disclosed as being at their opened retracted or non-deployed positions.

In operation, it is therefore to be further appreciated that when the guide fingers 38,40 are disposed at their extended or closed positions as illustrated in FIG. 3, the guide fingers 38,40 are disposed beneath a piece or unit of mail, or similar article, 24 being discharged from the conveyor belt section 16 and being introduced into the stacking chamber or compartment 26 and are able to vertically support the leading or downstream edge portion of the particular piece or unit of mail, or similar article, until the forward, leading, or downstream edge portion of the article or piece of mail 24 is deposited either upon the floor member 30 of the stacking chamber or compartment 26, or upon the uppermost article or piece of mail 24 disposed upon the stack of mail or articles 28 disposed within the stacking chamber or compartment 26. In this manner, significant curling, curving, sagging, or the like, is effectively prevented such that the particular article or piece of mail 24 cannot roll over upon itself or become lodged within the space 36 defined between the stack of mail or articles 28 and the rear or upstream wall member 34 of the stacking chamber or compartment 26. Subsequently, when the forward, leading, or downstream edge portion of the article or piece of mail 24 is in fact deposited either upon the floor member 30 of the stacking chamber or compartment 26, or upon the uppermost article or piece of mail 24 disposed upon the stack of mail or articles 28 disposed within the stacking chamber or compartment 26, the guide fingers 38,40 are then moved or returned to their retracted or opened positions as illustrated in FIG. 4 whereby the guide fingers 38,40 are effectively removed from their disposition beneath the article or piece of mail 24 being introduced into the stacking chamber or compartment 26 and are now disposed behind or upstream of the trailing or upstream edge portion of the article or piece of mail 24 being introduced into the stacking chamber or compartment 26 whereupon the trailing end portion, of the article or piece of mail 24 being introduced into the stacking chamber or compartment 26, is effectively released from the guide fingers 38,40 and is now permitted to fall downwardly and be disposed in a substantially flat state either upon the floor member 30 of the stacking chamber or compartment 26 or upon the uppermost article or piece of mail 24 disposed upon the stack of mail or articles 28. The guide fingers are now of course ready to again be moved to their closed or extended position in preparation for supporting the leading or downstream edge portion of a newly conveyed piece of mail or article 24. This cyclical operation of the guide fingers 38, 40, with respect to the serial conveyance of the pieces or units of mail, or articles 24, is of course controlled by means of the aforenoted light-beam sensing and software-controlled system used in conjunction with the conveyor system 10.

It is further noted that in addition to the guide fingers 38,40 facilitating the deposition of the pieces of mail or articles 24 into the stacking chamber or compartment 26, and onto the floor 30 of the chamber or compartment 26 or onto the stack of mail or articles 28, in a relatively flat, non-rollover state, the inclination of the guide fingers 38,40 also serves to prevent, reduce, or control bounceback of the pieces or mail or articles 24 off or from the downstream end wall 32 of the stacking chamber or compartment 36 when they encounter the downstream end wall 32 of the stacking chamber or compartment 26 in view of the relatively high rate of speed at which the pieces of mail or articles 24 are conveyed and introduced into the stacking chamber or compartment 26. This is because the downward inclination of the guide fingers 38,40 serves in effect to force the incoming mail pieces or articles 24 back toward the downstream end wall 32 of the stacking chamber or compartment 26 should any of the mail pieces or articles 24 experience bounce-back. This effect also serves to facilitate the uniform arrangement or disposition of the mail units or pieces, or articles, 24 within the stacked array 28 in view of the fact that the mail pieces or articles 24 will tend or be forced to settle into position against the downstream end wall 32 of the stacking chamber or compartment 26.

In a similar manner, it is also to be noted, as may best be appreciated from FIG. 4, that when the guide fingers 38,40 are being moved from their closed extended positions as shown in the phantom lines, to their opened retracted positions shown in solid lines, and in view of the axially central disposition of the guide fingers 38,40 with respect to the conveyor 12 and the normal disposition of the pieces of mail or articles 24 upon the conveyor 12, it is apparent that the right guide finger 40 will be cleared or removed from contact with respect to the most currently deposited piece of mail or article 24, introduced or deposited into the stacking chamber or compartment 26 and now disposed atop the guide fingers 38,40, prior to the clearance or removal of the left guide finger 38 from contact with respect to the most currently deposited piece of mail or article 24, introduced or deposited into the stacking chamber or compartment 26 and now disposed atop the guide fingers 38,40. In this manner, as the left guide finger 38 remains in contact with the undersurface of the piece of mail or article 24 just introduced or deposited within the stacking chamber or compartment 26, after the guide finger 40 has been removed from any contact with such piece of mail or article 24, such piece of mail or article 24 will in effect be slightly moved or dragged toward the left as viewed in FIG. 4 thereby again tending to arrange the pieces of mail or articles in a uniform manner within the stacked array of mail or articles 28.

Thus, it may be seen that in accordance with the principles and teachings of the present invention, a new and improved article conveyor or transportation system, particularly a conveyor or transportation system which is especially useful in connection with the sorting, transporting, handling, and stacking of pieces or units of mail, or similar articles, has been developed wherein the various pieces or units of mail, or similar articles, can be conveyed or transported, for example, from the belt conveyor toward and into the stacking chamber, receptacle, or compartment in a substantially flat state regardless of the inherent tendency of the particular pieces or units of mail, or similar articles, to either curl, curve, or sag, as a result of the pieces of mail or articles having their leading or downstream edge portions vertically supported by the guide fingers which extend downstream from the belt conveyor and into the stacking chamber or compartment. In this manner, the pieces or units of mail, or similar articles, can be properly stacked within the stacking chamber, receptacle, or compartment so as not to cause any hindrance to the continuous conveyance or transportation of the pieces or units of mail, or similar articles, whereby, further, the article conveyor or transportation system can operate in a substantially continuous manner without experiencing any jamming or the like which would necessarily require maintenance personnel to rectify the problem while the apparatus or system would experience substantial operational downtime. Additionally, subsequent flat articles are maintain in serial order as a result of the same being stacked flat on top of the previous piece.

Obviously, many variations and modifications of the present invention are possible in light of the above teachings. For example, in lieu of the two guide fingers 38,40, that is, in lieu of the single disclosed pair of guide fingers 38,40, it is also contemplated within the scope of the present invention to provide the conveyor system 10 with a number of guide fingers which is greater than two. For example, four, or even six, guide fingers may be provided, instead of the two guide fingers as disclosed, and the guide fingers would be divided into two groups of guide fingers wherein each group of guide fingers would have an equal number of guide fingers. The guide fingers would still be operable in the aforenoted scissors-type mode of operation so as to still achieve the basic operative concepts of the present invention. It is therefore to be understood that within the scope of the appended claims, the present invention may be practiced otherwise than as specifically described herein.

What is claimed as new and desired to be protected by Letters Patent of the United States of America, is:

1. A conveyor system, comprising:

a conveyor, defining a conveying surface having an upstream end and a downstream end, for conveying flat articles in a conveying direction extending downstream toward a first support surface upon which the articles can be accumulated; and at least one guide finger which extends downstream from said downstream end of said conveyor and which defines a second support surface for supporting the articles as they are conveyed from said conveyor toward said first support surface, said at least one guide finger being pivotally movable between a first extended position at which said at least one guide finger extends substantially parallel to said conveying direction of said conveyor so as to be disposed over the first support surface and thereby support the articles as they are conveyed from said conveyor toward said first support surface, and a second retracted position at which said at least one guide finger extends substantially transversely with respect to said conveying direction of said conveyor so as to permit the articles to be deposited onto said first support surface and thereby ensure that the articles are deposited onto said first support surface in an orderly manner.

2. The conveyor system as set forth in claim 1, wherein:

said at least one guide finger comprises at least two guide fingers.

3. The conveyor system as set forth in claim 2, wherein:

said at least two pivotally movable guide fingers are movable in a scissors-type mode of operation between a closed position at which said at least two pivotally movable guide fingers are disposed substantially parallel to each other, and an opened position at which said at least two pivotally movable guide fingers are disposed co-linear with respect to each other.

4. The conveyor system as set forth in claim 2, wherein:

said at least two pivotally movable guide fingers are movable in a scissors-type mode of operation between a closed position at which said at least two pivotally movable guide fingers are disposed substantially parallel to each other so as to support a leading edge portion of an article as the article is being conveyed from said conveyor onto said first support surface, and an opened position at which said at least two pivotally movable guide fingers are disposed co-linear with respect to each other so as to release the article in order to permit the article to be completely deposited onto the first support surface.

5. The conveyor system as set forth in claim 2, wherein:

said at least two guide fingers are inclined downwardly with respect to said conveying surface of said conveyor so as to facilitate deposition of the articles onto the first support surface in a substantially flat state.

6. The conveyor system as set forth in claim 2, wherein:

said at least two pivotally movable guide fingers are movable in a scissors-type mode of operation between a closed position and an opened position.

7. The conveyor system as set forth in claim 4, further comprising:

an actuating system for actuating said at least two guide fingers so as to move said at least two guide fingers between said opened and closed positions.

8. The conveyor system as set forth in claim 7, wherein said actuating system comprises:

an actuator;

an actuator linkage member operatively connecting said actuator to a first one of said at least two guide fingers; and a connecting linkage member operatively interconnecting said at least two guide fingers together.

9. The conveyor system as set forth in claim 8, wherein:

said actuator comprises a linear solenoid-type actuator.

10. The conveyor system as set forth in claim 8, wherein:

said actuator comprises a linear pneumatic-type actuator.

11. A conveyor system, comprising:

a first support surface onto which articles are to be stacked in an orderly manner;

a conveyor, defining a conveying surface having an upstream end and a downstream end, for conveying flat articles in a conveying direction extending downstream toward said first support surface upon which the articles are to be accumulated; and at least one guide finger which extends downstream from said downstream end of said conveyor and which defines a second support surface for supporting the articles as they are conveyed from said conveyor toward said first support surface, said at least one guide finger being pivotally movable between a first extended position at which said at least one guide finger extends substantially parallel to said conveying direction of said conveyor so as to be disposed over said first support surface and thereby support the articles as they are conveyed from said conveyor toward said first support surface, and a second retracted position at which said at least one guide finger extends substantially transversely with respect to said conveying direction of said conveyor so as to permit the articles to be deposited onto said first support surface and thereby ensure that the articles are deposited onto said first support surface in an orderly manner.

12. The conveyor system as set forth in claim 11, wherein:

said at least two pivotally movable guide fingers are movable in a scissors-type mode of operation between a closed position at which said at least two pivotally movable guide fingers are disposed substantially parallel to each other so as to support a leading edge portion of an article as the article is being conveyed from said conveyor onto said first support surface, and an opened position at which said at least two pivotally movable guide fingers are disposed co-linear with respect to each other so as to release the article in order to permit the article to be completely deposited onto said first support surface.

13. The conveyor system as set forth in claim 12, wherein:

said at least two pivotally movable guide fingers are mounted at substantially axially central locations with respect to said conveyor such that when said at least two pivotally movable guide fingers are moved to their opened position, a first one of said at least two guide fingers will be released from contact with the article deposited onto said first support surface before the second one of said at least two guide fingers is released from contact with the article deposited onto said first support surface such that said second one of said at least two guide fingers causes the articles, to be stacked upon said first support surface, to be moved toward a stacking position upon said first support surface whereby the articles are uniformly stacked upon said first support surface.

14. The conveyor system as set forth in claim 11, wherein:

said at least one guide finger comprises at least two guide fingers.

15. The conveyor system as set forth in claim 14 ,wherein:

said at least two pivotally movable guide fingers are movable in a scissors-type mode of operation between a closed position at which said at least two pivotally movable guide fingers are disposed substantially parallel to each other, and an opened position at which said at least two pivotally movable guide fingers are disposed co-linear with respect to each other.

16. The conveyor system as set forth in claim 14, wherein:

said at least two guide fingers are inclined downwardly with respect to said conveying surface so as to facilitate deposition of the articles onto said first support surface in a substantially flat state.

17. The conveyor system as set forth in claim 14, wherein:

said at least two guide fingers are inclined downwardly with respect to said plane of said conveying surface so as to facilitate deposition of the articles onto said first support surface in a substantially flat state and to control bounce-back of the articles upon said first support surface when the articles encounter said first support surface.

18. The conveyor system as set forth in claim 14, wherein:

said at least two pivotally movable guide fingers are movable in a scissors-type mode of operation between a closed position and an opened position.

19. The conveyor system as set forth in claim 18, further comprising:

an actuating system for actuating said at least two guide fingers so as to move said at least two guide fingers between said opened and closed positions.

20. The conveyor system as set forth in claim 19, wherein said actuating system comprises:

an actuator;

an actuator linkage member operatively connecting said actuator to a first one of said at least two guide fingers; and a connecting linkage member operatively interconnecting said at least two guide fingers together.

21. The conveyor system as set forth in claim 20, wherein:

said actuator comprises a linear solenoid-type actuator.

22. The conveyor system as set forth in claim 20, wherein:

said actuator comprises a linear pneumatic-type actuator.

* * * * *